US006683444B2

(12) United States Patent
Marie

(10) Patent No.: US 6,683,444 B2
(45) Date of Patent: Jan. 27, 2004

(54) PERFORMANCE REFERENCE VOLTAGE GENERATOR

(75) Inventor: Herve Jean Francois Marie, Ver-sur-Mer (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/321,202

(22) Filed: Dec. 17, 2002

(65) Prior Publication Data

US 2003/0137287 A1 Jul. 24, 2003

(30) Foreign Application Priority Data

Dec. 20, 2001 (FR) ..... 01 16573

(51) Int. Cl.[7] ..... G05F 3/16; G05F 3/20
(52) U.S. Cl. ..... 323/314; 323/316
(58) Field of Search ..... 323/313, 315, 323/314, 316

(56) References Cited

U.S. PATENT DOCUMENTS 6,016,051 A * 1/2000 Can ..... 323/315
6,118,264 A * 9/2000 Capici ..... 323/316
6,133,719 A * 10/2000 Maulik ..... 323/313
6,150,872 A * 11/2000 McNeill et al. ..... 327/539
6,570,371 B1 * 5/2003 Volk ..... 323/315
6,605,987 B2 * 8/2003 Eberlein ..... 327/540

OTHER PUBLICATIONS

"A simple Three–Terminal IC Bandgap Reference", A. Paul Brokaw, IEEE Journal of Solid State Circuits, vol. SC–9, No. 6, Dec. 1974, pp. 388 to 393.

* cited by examiner

*Primary Examiner*—Bao Q. Vu
(74) *Attorney, Agent, or Firm*—Aaron Waxler

(57) ABSTRACT

The invention relates to a reference voltage generator which comprises, arranged between two supply terminals (20, 21), an input stage (1) having a portion (R0) proportional to the absolute temperature and delivering a potential which is substantially independent of temperature, connected to an operational amplifier (2) which delivers the reference voltage (Vref) and is fed back to the input stage. The components of the operational amplifier (2) are chosen so that even in an open loop arrangement (3) the reference voltage is substantially independent of the supply voltage, and the manufacturing method and has a given dependence on temperature.

15 Claims, 8 Drawing Sheets

PERFORMANCE REFERENCE VOLTAGE GENERATOR

FIELD OF THE INVENTION

The present invention relates to a generator of at least one reference voltage with improved performance. Reference voltage generators may be used in a great number of applications such as converters in which it is necessary to have a voltage value that is precise and stable whatever the environmental conditions are. This is notably the case when the reference voltage is based on the energy band. These voltage generators are known by the English name of bandgap generators in the literature. In an integrated circuit the potential barrier of a PN junction corresponding to the forbidden bandwidth of the semiconductor, that is 1.205 volts in the case of silicon, is used as a reference voltage.

BACKGROUND OF THE INVENTION

It is tried for these reference voltage generators to have a temperature gradient that is well known and even often to be independent of temperature variations. These reference voltage generators are constituted by various electronic components which themselves have their own dependence on temperature and the control of the temperature gradient of the assembly is difficult.

The value of the reference voltage delivered by this reference voltage generator must not be dependent on the manufacturing process of the various electronic components of the generator. These reference voltage generators are produced in the form of monolithic integrated circuits and it is a known practice that components having the same characteristics finally have different cost.

Moreover, it is tried for the reference voltage delivered by such generators to be the least possible affected by faults of the supply source that feeds them. The signals delivered by the supply sources inevitably comprise disturbances: parasitic random noise, noise, voltage peaks. These faults need not affect the reference voltage delivered by the generator. In conclusion, it is tried for the reference voltage generator to have as large a power supply rejection ratio as possible on a large frequency band. It is the ratio between a variation of the output voltage of the reference voltage generator brought about by a variation of the supply voltage and said variation of the supply voltage, this magnitude is known by the English abbreviation PSRR for Power Supply Rejection Ratio.

Finally, it is also tried for the reference voltage generator to have a good load rejection and to have the shortest possible response time at the start.

The reference voltage generators of known type are such that their output voltage combines with appropriate weight factors a base-emitter voltage of a bipolar transistor and a voltage proportional to the absolute temperature T. The choice of the weight factors is made so that the voltage variations proportional to the absolute temperature compensate for those of the base-emitter voltage of the bipolar transistor.

An example of a reference voltage generator known from the article "A Simple Three-Terminal IC Bandgap Reference", A. Paul BROKAW, IEEE Journal of Solid State Circuits, vol. SC-9, no. 6, December 1974, pp. 388 to 393, is illustrated in FIG. 1. It is formed by an input stage 1 having two branches 10, 11 connected between two supply terminals 20, 21, one terminal 20 connected to a high potential Vcc, the other terminal 21 connected to a low potential Vee, generally ground. In each of the branches 10, 11 is found at least a bipolar transistor Q1, Q2 and these transistors do not have the same size of emitter. This input circuit 1 combines a base-emitter voltage of one of the bipolar transistors Q2 with a voltage proportional to the absolute temperature (known by the voltage name PTAT, PTAT being the English abbreviation for Proportional To Absolute Temperature) and it is the voltage resulting from this combination that forms the reference voltage Vref.

This input circuit 1 is associated with an operational amplifier 2 which, while attenuating the variations of the supply voltage Vcc−Vee, maintains the same current in the two branches 10, 11. The operational amplifier is configured to have a largest possible gain.

More precisely, the two transistors Q1, Q2 have a common base, their collectors connected to the supply terminal 20 connected to the potential Vcc via a resistor R2, R3, respectively. The emitter of the first transistor Q1 is connected to the other supply terminal 21 by a series combination 12 of two resistors R1, R0. The emitter of the second transistor Q2 is connected to the other supply terminal 21 via one of the resistors R0 of the series combination 12. It is supposed that the emitter surface of the first transistor Q1 is equal to n (n being an integer greater than one) times that of the second transistor Q2. For example, n may be equal to 8.

The operational amplifier 2 may adopt a conventional form with a differential amplifier stage 13 and an output stage 14. In FIG. 1 the differential amplifier stage 13 comprises a differential pair 15 of transistors Q3, Q4 whose bases form the two differential inputs. The base of the transistor Q3 is connected to the branch 11 at the transistor collector Q2, the base of the transistor Q4 is connected to the branch 10 at the collector of the transistor Q1. The emitters of the transistors Q3 and Q4 are interconnected. They are connected to the supply terminal 21 connected to the potential Vee via a source resistor R4. The collectors of the two transistors Q3, Q4 are each connected to the supply terminal 20 connected to the potential Vcc via a load resistor R5, R6, respectively. The output stage 14 comprises a follower circuit 22 with a transistor Q5 whose emitter is connected to the supply terminal 21 connected to the potential Vee via a resistor R7 whose collector is connected to the supply terminal 20 connected to potential Vcc and whose base is connected to the emitter of the transistor Q4 of the differential amplifier 13.

The output of the reference voltage generator is found at the bases of the transistors Q1, Q2 of the input stage 1 which are connected to the emitter of the transistor Q5 of the output stage 14. The operational amplifier 2 compares the currents flowing in the two branches 10, 11 and provides that they remain substantially equal whatever the variations of the supply power.

The voltage Vref delivered by this reference voltage generator has the value of: Vref=Vbe(Q2)+R0.I0, Vbe(Q2) representing the base-emitter voltage of the transistor Q2 and I0 being the current flowing in the resistor R0.

It may be stated that Vbe(Q2)−Vbe(Q1)=R1.I1.

But Vbe(Q2)−Vbe(Q1)=$V_T$.Log(n) with $V_T$ being the thermal voltage. This thermal voltage $V_T$ is equal to kT/Q where k is the Boltzmann constant, T the temperature in degrees Kelvin and Q the charge of the electron.

The voltage at the terminals of the resistor R0 is equal to: 2.$V_T$.Log(n).R1/R0 since the same currents are flowing in the transistors Q1, Q2.

The reference voltage Vref is such that:

$$Vref=Vbe(Q2)+2.V_T.Log(n).R1/R0.$$

The ratio of the resistances R1/R0 may thus be adjusted so that in the sum the variations of the term proportional to $V_T$ practically compensate for those of Vbe(Q2). But in an open loop arrangement the reference voltage Vref follows the variations of the supply voltage.

One of the drawbacks of this generator is that the precision of the voltage obtained is not very good if not a high gain operational amplifier is used. But a high gain amplifier has a high energy consumption and needs to be stabilized. Its passband is small and so is its supply voltage rejection.

Another drawback is that the reference voltage generator needs to have a start circuit (not shown). Actually, the circuit is found in a stable mode when no current is flowing in the transistors Q1, Q2 and when they are in a blocked state. The start circuit has for its function to inject a current in the charging circuit of the differential pair thus increasing the emitter voltage of the transistors of the differential pair and, in consequence, the voltage at the base of the transistors of the input circuit. Such a start circuit requires a number of active components, for example, various MOS transistors which operate as switches, a current mirror with bipolar transistors and several resistors. This notably increases the cost of the reference voltage generator.

SUMMARY OF THE INVENTION

It is an object of the present invention to propose a reference voltage generator which is as insensitive as possible to supply voltage variations and the manufacturing process, whose dependence on temperature is given and which does not have the disadvantages of the reference voltage generator of FIG. 1, that is, the necessity to utilize a high-gain operational amplifier and the necessity to include a startup circuit.

To achieve this, the present invention relates to a generator of at least one reference voltage comprising, connected between two power supply terminals, an input stage having a portion that is proportional to the absolute temperature and delivering a potential that is substantially independent of temperature, an operational amplifier comprising:

a differential amplifier stage connected to the input stage including a charging circuit and a source circuit and an output stage connected at a first node to the charging circuit, intended to be connected to the input stage by a loop which is closed and delivering the reference voltage.

The source circuit and the charging circuit comprise regulation means for regulating the reference voltage even when the loop connecting the input stage to the output stage is open, which reference voltage is then delivered in a manner substantially independent of the manufacturing process of the generator, variations of the supply voltage and has a given dependence on temperature.

The regulation means impose that with an open loop, during a variation of the supply voltage, substantially the same variation is reflected in the source circuit as in the charging circuit in a way that the voltage appearing on the first node is practically independent of the variations of the supply voltage, the voltage in the source circuit being substantially independent of temperature.

The differential amplifier may comprise a differential pair of transistors and the source circuit may comprise a resistor and a diode connected in series, the resistor being connected to the differential transistor pair and the diode to one of the supply terminals, the diode having a temperature gradient so that, even when the loop is open, said gradient compensates for the temperature gradients of the input stage and of the differential amplifier stage in such a way that the voltage on the terminals of the resistor is substantially independent of temperature and manufacturing process.

The charging circuit may comprise a resistor connected between the first node and one of the supply terminals, the ratio between the value of the resistance of the charging circuit and the value of the resistance of the source circuit being adjusted in such a way that, even with an open loop, during a variation of the supply voltage, substantially the same variation is reflected on the source circuit and on the charging circuit, so that the voltage appearing on the first node is practically independent of the variations of the supply voltage.

The operational amplifier may comprise a compensation circuit connected to the first node and to the output stage at a second node with the closed loop, the compensation circuit and the source circuit maintaining on the first node a voltage that substantially compensates for the voltage produced by the output stage, rendering the voltage on the second node substantially independent of temperature and variations of the supply voltage even when the loop is open.

The compensation circuit may comprise a bipolar transistor whose emitter is connected to one of the supply terminals through a resistor, whose collector is connected to the first node and whose base is connected to the output stage at the second node.

The output stage may comprise a follower circuit including a bipolar transistor whose emitter is connected to one of the supply terminals through at least one resistor and to the loop when it is closed, whose collector is connected to the other supply terminal and whose base is connected to the first node, one output of the generator being found at the emitter of the bipolar transistor.

The output stage may comprise a follower circuit with a including transistor whose emitter is connected to one of the supply terminals through a voltage divider bridge and to the loop when it is closed, whose collector is connected to the other supply terminal and whose base is connected to the first node, one output of the generator being found at a common point between two resistors of the voltage divider bridge.

The output stage may comprise, in association with the follower circuit, a regulation circuit for regulating the temperature gradient of the voltage on the first node, this regulation circuit being connected between the first node and one of the supply terminals and being connected to a common point between two resistors of the voltage divider bridge, this regulation circuit generating a current whose temperature gradient is adjustable by the choice of the resistors of the bridge.

The regulation circuit may comprise a bipolar transistor whose emitter is connected to one of the supply terminals through a resistor, whose collector is connected to the first node and whose base is connected to the common point between two resistors of the voltage divider bridge, one output of the generator being found at the emitter of the transistor of the regulation circuit.

The regulation circuit may co-operate with an additional circuit that has a transistor for forming a current mirror, the output being found at the emitter of the transistor of the additional circuit.

It may be interesting in certain applications that the generator comprises a standby circuit for putting the generator in the standby mode, the standby circuit including various pairs of complementary MOS transistors located in the differential amplifier stage and a pair of complementary MOS transistors located in the output stage, these MOS transistors being controlled by a standby mode control device.

This generator is adapted in all respects for delivering a reference voltage based on the forbidden energy band of a semiconductor material.

The invention also relates to a converter including a generator according to the invention and an apparatus intended for the reception and transmission of radio telecommunication signals including a generator according to the invention. Such an apparatus may be, for example, a telephone which may include, for example, a converter according to the invention.

Such converters and radio telecommunication apparatus which may advantageously include a generator according to the invention are described abundantly in the literature with other types of generators.

BRIEF DESCRIPTION OF THE DRAWINGS

These and other aspects of the invention are apparent from and will be elucidated, by way of non-limitative example, with reference to the embodiments described hereinafter.

In the drawings.

In these Figures identical elements are indicated by identical reference characters.

DETAILED DESCRIPTION OF PREFERRED EMBODIMENTS

Figure 2:
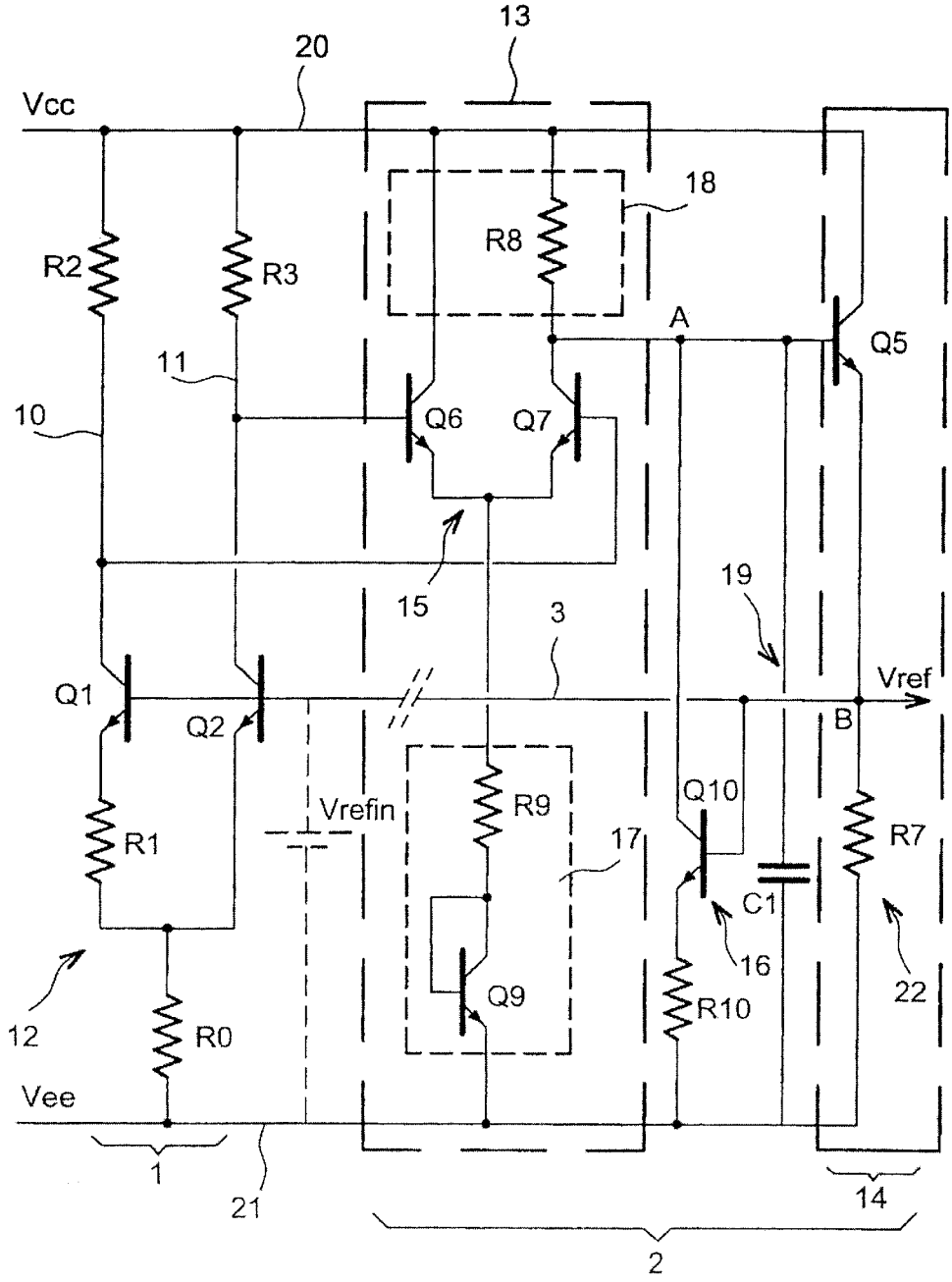
FIG. 2 is an electrical diagram of an example of a reference voltage generator according to the invention.

Now FIG. 2 will be referred to which shows in detail an example of a generator of at least one reference voltage Vref according to the invention.

Figure 1:
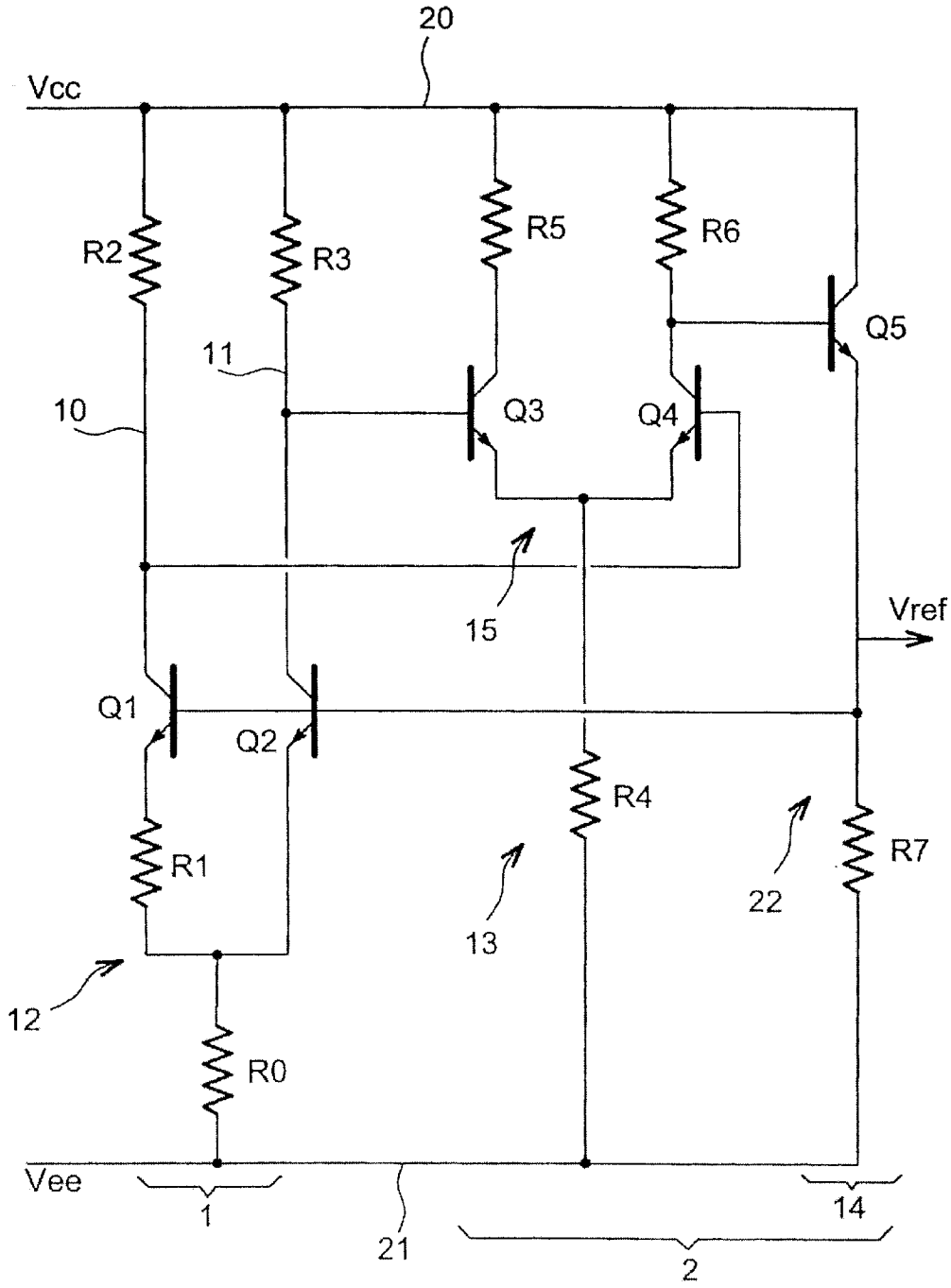
FIG. 1 (already described) is an electrical diagram of a reference voltage generator of known type.

In this generator there is an input stage 1, similar to that of FIG. 1, and an operational amplifier 2. The input stage will not be described again and its various elements have like references to those of FIG. 1.

As regards the operational amplifier 2, it comprises a differential amplifier stage 13, an output stage 14, a compensation circuit 16. The output stage 14 is similar to that of FIG. 1 with a follower circuit 22 which will not be described again. It is connected to a loop 3 to the input stage 1 at the common base of the two transistors Q1, Q2 of the input stage 1. The two transistors Q1, Q2 have different emitter surfaces that are each other's multiples. The reference voltage Vref is delivered by the output stage 14. Its elements have like references to those of FIG. 1.

The differential amplifier stage 13 comprises a differential pair 15 of transistors Q6, Q7 connected to the input stage 1 and arranged between the two supply terminals 20, 21 via a source circuit 17 and a charging circuit 18. More precisely, the bases of the two transistors Q6, Q7 form the two differential inputs of the stage 13. The base of transistor Q6 is connected to the branch 11 at the collector of the transistor Q2, the base of the transistor Q7 is connected to the branch 10 at the collector of the transistor Q1. The emitters of the transistors Q6, Q7 are interconnected. They are connected to the supply terminal 21 connected to the potential Vee by the source circuit 17 which is now an active circuit.

The source circuit 17 and charging circuit 18 comprise regulation means R8, R9 for regulating the reference voltage Vref even when the loop 3 is open. This reference voltage Vref is then delivered substantially independently of the manufacturing process of the generator, variations of the supply voltage and with a given dependence on temperature.

The source circuit 17 comprises in a series combination a diode represented by a transistor Q9 arranged as a diode, and a resistor R9 which forms part of the regulation means. The resistor is connected to the common emitters of the transistors Q6, Q7 of the differential pair 15. The collectors of the two transistors Q6, Q7 are connected each to the supply terminal 20 connected to the potential Vcc via the charging circuit 18. This charging circuit 18 comprises a resistor R8 which forms part of the regulation means, arranged between the collector of the transistor Q7 of the differential pair and the supply terminal 20. The collector of the other transistor Q6 of the differential pair 15 is directly connected to the supply terminal 20. The output stage 14 is connected in a first node A to the charging circuit 18 at the collector of the transistor Q7.

The compensation circuit 16 is an active circuit which comprises a transistor Q10 whose collector is connected to the first node A, that is to say, to the resistor R8 and to the output stage 14 at the base of the transistor Q5, and whose emitter is connected to the supply terminal 21 through a resistor R10. The base of the transistor Q10 is connected to the common base of the transistors Q1, Q2 of the input stage.

Figure 3:
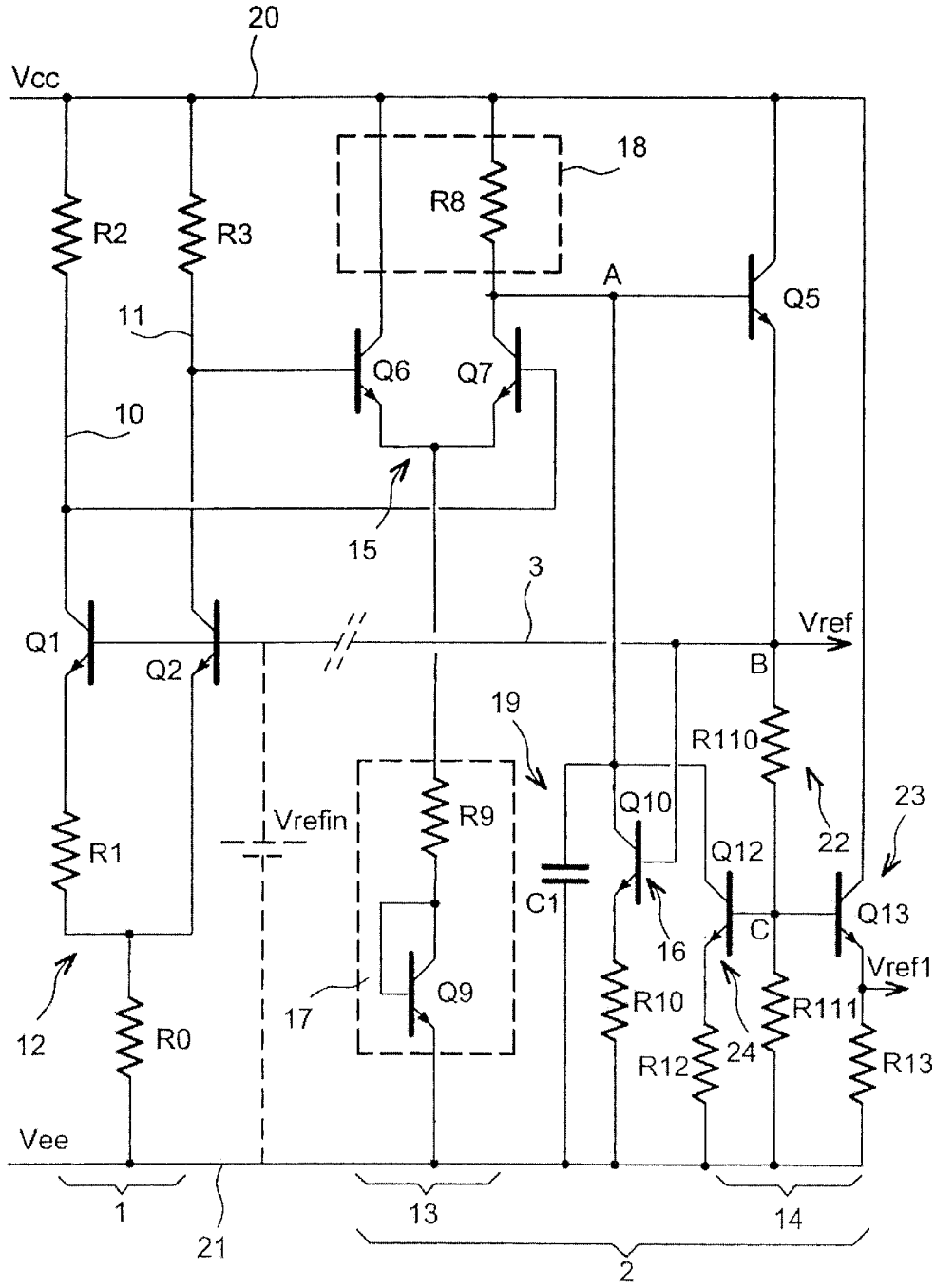
FIG. 3 is an electrical diagram of another example of a reference voltage generator according to the invention.

In this example the reference voltage Vref is available on a second node B which corresponds to the link between the emitter of the output transistor Q5, the resistor R7 and the loop 3. It may be imagined that the reference voltage is available at another location of the output stage 14 as illustrated in FIG. 3 described later and even that various reference voltages having different values and/or temperature gradients are delivered by the voltage generator according to the invention.

The regulation means of the source circuit 17 and the charging circuit 18 by their configuration impose that the voltage appearing on the first node A is practically independent of variations of the supply voltage Vcc−Vee.

Actually, the ratio of the resistances R9 and R8 of the regulation means is chosen such that a variation δ(Vcc−Vee) of the supply voltage brings forth substantially the same variation δ(Vcc−Vee) in the source circuit 17 and the charging circuit 18 on the terminals of the load resistor R8 and this whatever the temperature. In consequence, the first node A does not vary its voltage during a variation of the supply voltage. The ratio of the resistances R8/R9 of the regulation means is chosen such that the common mode gain of the amplifier formed by the differential stage 13 and the resistors R2, R3 is adjusted to the value −1. This is effected when the ratio of the resistance values R8/R9 is approximately 2, the current in the resistor R9 being substantially equal to twice that passing through the load resistor R8. Moreover, the source circuit 17 is configured for generating a current that is substantially independent of temperature which narrows down to observing that the resistor R9 is adjusted so that the voltage on its terminals is substantially independent of temperature. This is verified for all temperatures if the following adjustment is realized at the input stage 1.

The voltage $V_{R9}$ on the terminals of the resistor R9 is expressed by:

$$V_{R9} = (Vcc - Vee) - (V_{R3} + V_{BE}(Q6) + V_{BE}(Q9))$$

$$V_{R9} = (Vcc - Vee) - (V_{R3} + 2v_{BE}).$$

The term $(V_R3+2V_{BE})$ is thus to be substantially independent of temperature, which happens if it is equal to 2Vref for example and if the temperature gradient of the peak resistance R3 compensates for those of the two base-emitter voltages of the transistors Q6 and Q9. This permits to render the reference voltage generator which is the object of the invention insensitive to the manufacturing process. With the notation explained hereinafter the temperature gradient of the resistor R3 is substantially equal to one and that of the voltage on the terminals of the resistor R9 substantially equal to zero. The two collector resistors R2, R3 of the input stage 1 are identical. A same current is flowing in the transistors Q1, Q2 of the input stage, this current having a gradient substantially equal to one.

Now the contribution of the compensation circuit 16 and of the source circuit 17 to the variation of the voltage on the first node A as a function of temperature will be looked at.

First an extremely simple and homogeneous manner of comparing the temperature gradients of the various electronic components will be presented, which are interesting in the case of the reference voltage generator. Various units are frequently used for designing temperature gradients, if resistors are concerned this is expressed in ppm/° C. while it is about −2 mV/° C. for the base-emitter voltage VBE of a bipolar transistor.

It is assumed that the magnitude without dimension t is such that: $t=(T-T_0)/T_0$, with T being the temperature considered and $T_0$ the reference temperature, for example, equal to 25° C. The following values of t are obtained relative to the current temperatures T:

t=−1 for T=−273° C. or 0° K.

t=−¼ for T=−50° C.

t=0 for T=25° C.

t=+¼ for T=100° C.

A voltage may be expressed in the following way as a function of magnitude t: $V=V_0(a+bt+ct^2)$ with $V_0$ being the value of the voltage at the reference temperature To and a, b, c being coefficients. The first-order temperature gradient is given by:

$\alpha 1=b/a$ and the second-order temperature gradient is given by $\alpha 2=c/a$.

For a voltage that is proportional to the absolute temperature may be written:

$V_{PTAT}=V_{PTAT0}(1+t)$ and for a base-emitter voltage of a bipolar transistor:

$V_{BE}=V_{BE0}(1-t/2)$ with $V_{PTAT0}$ and $V_{BE0}$ being voltages at the reference temperature.

For a bipolar transistor $V_{be0}$=0.8 V.

It is deduced that the temperature gradient of a circuit whose voltage is proportional to the absolute value is 1 whereas the temperature gradient of the base-emitter voltage of the bipolar transistor is −0.5.

As regards the values of the resistances with this notation, their gradients may vary negatively or positively and adopt the value 0. In most cases the term α2 may be considered negligible except for the current gain β of the bipolar transistors.

It is tried to have the voltage on the second node B to be substantially independent of the temperature variations, which means that with this notation the voltage is to have a temperature gradient that is substantially equal to 0. In this example the reference voltage is tapped from the second node B.

For this purpose it is imposed that the temperature gradient of the voltage on the first node A is substantially equal and opposite to the voltage produced by the transistor Q5 of the output stage 14 to obtain the gradient compensation. It happens that the temperature gradient of the voltage on the first node A and thus on the terminals of the charging circuit 18 is to be equal to about 0.5 since the temperature gradient of a base-emitter voltage of a bipolar transistor is −0.5. This gradient depends on that of the source circuit 17 and on that of the compensation circuit 16. These two circuits comprise each a bipolar transistor Q9, Q10 whose temperature gradient is imposed and equal to substantially −0.5 and a resistor R9, R10, which is sufficient to adjust to impose that of the charging circuit 18. The temperature gradient of the compensation circuit 16 then adopts substantially the value 1 in the example described and that of the source circuit 17 substantially the value 0. The voltage on the terminals of the resistor R10 of the compensation circuit 16 varies substantially proportionally to the absolute value.

The Table at the end of the description regroups the characteristics as regards value, gradient and voltage assigned to each of the components of the reference voltage generator according to the invention.

With such a reference voltage generator even in the open loop 3 the voltage on the second node B, in the example the reference voltage Vref, is substantially independent of temperature, supply variations and of the manufacturing process. When it operates in an open loop 3, the emitter of the transistor Q5 of the output stage 14 and the base of the transistor Q10 of the compensation circuit 16 are connected to the second node B, but they are no longer connected to the base of the transistors Q1, Q2 of the input stage. A voltage Vrefin which is substantially equal to the voltage Vref desired on the output is applied to the base of the transistors Q1, Q2 of the input circuit 1. The operational amplifier 2 having nothing left to correct because the voltage on the second node B is highly independent of the temperature and supply variations and this even with an open loop, may have little gain.

Figure 5A:
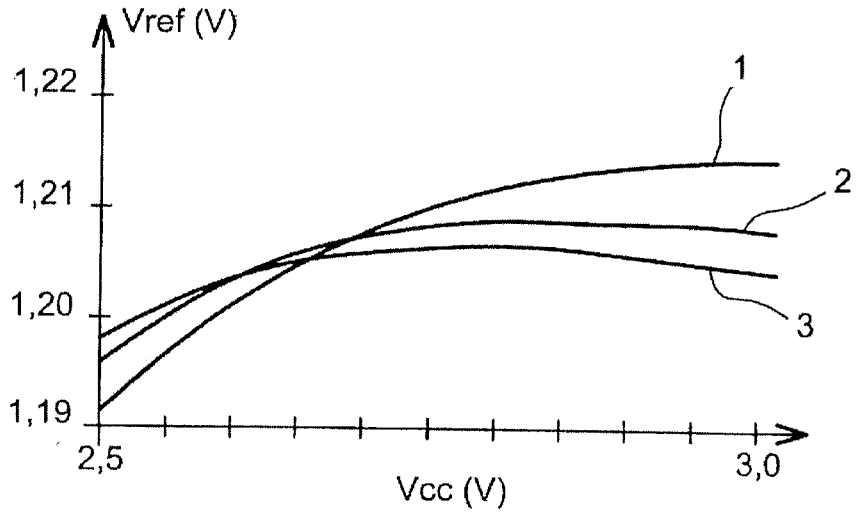
FIGS. 5A, 5B show in an open loop and closed loop, respectively, the variations of the reference voltage as a function of the supply voltage for various temperatures.
Figure 5B:
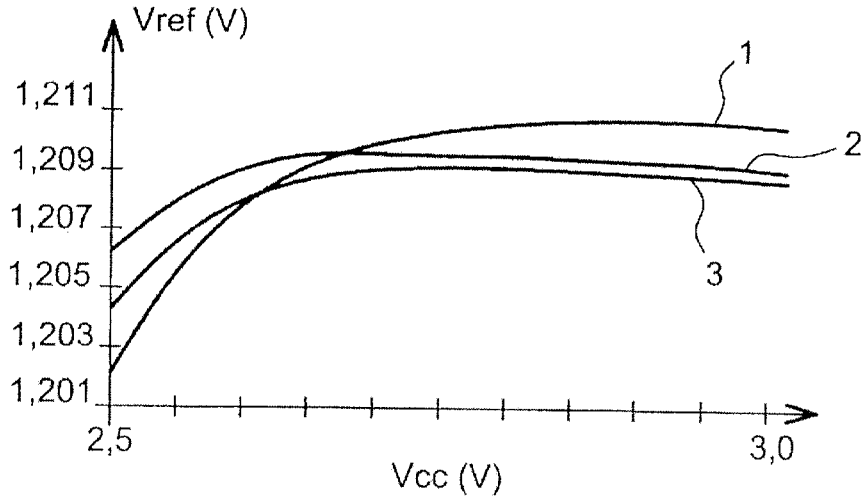

FIGS. 5A, 5B are curves of variations of the reference voltage delivered by the generator of FIG. 2 as a function of the supply voltage Vcc in an open and a closed loop, respectively. The three curves correspond to different temperatures. The curve referred to as 1 corresponds to 120° C., the curve referred to as 2 corresponds to 27° C., the curve referred to as 3 corresponds to −30° C. It is supposed that Vee represented ground. The curves are substantially flat over a large range of voltages.

Figure 6A:
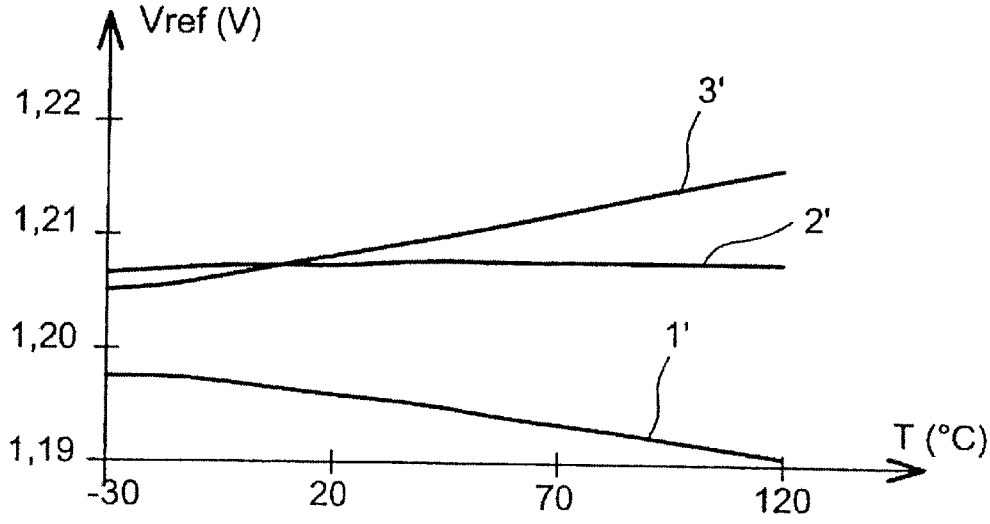
FIGS. 6A, 6B show in an open loop and closed loop, respectively, the variations of the reference voltage as a function of the temperature for various supply voltages.
Figure 6B:
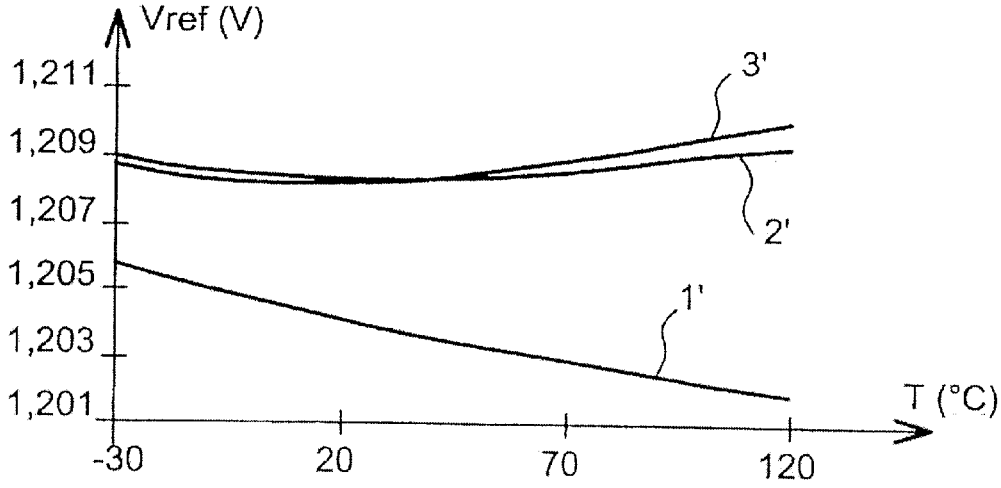

The FIGS. 6A, 6B are curves of the variations of the reference voltage delivered by the generator of FIG. 2 as a function of the temperature in the open loop and closed loop, respectively. The three curves correspond to different supply voltages. The curve referred to as 1' corresponds to a voltage of 2.5 V, the curve referred to as 2' to a voltage of 2.7 V, the curve referred to as 3' to a voltage of 3 V. The curves are substantially flat over a large range of temperatures.

As the operational amplifier 2 can function in the open loop, there are no longer two stable points in which the transistors Q1, Q2 of the input circuit 1 are passed through by no current at all like in the prior art. No start circuit is required.

Figure 7:
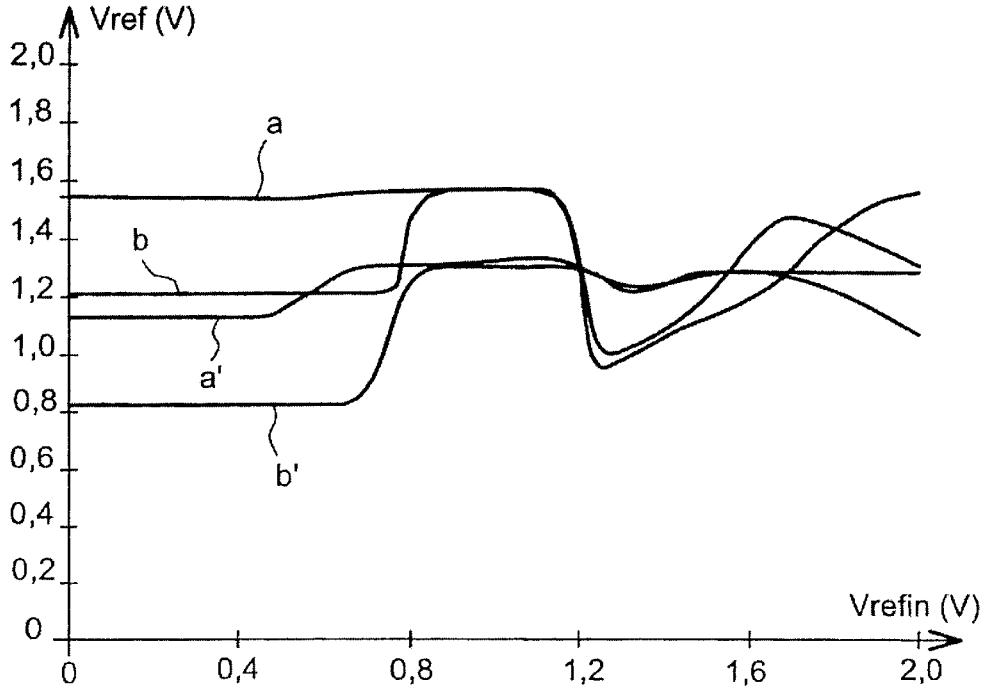
FIG. 7 shows the variations of the reference voltage Vref as a function of the voltage Vrefin applied to the base of the transistors of the open loop input stage for various supply voltages and various temperatures.

FIG. 7 represents variations of the reference voltage Vref as a function of the voltage Vrefin for various temperatures and various supply voltages. The curve a corresponds to a supply voltage of 3 V and a temperature of 120° C., the curve b corresponds to a supply voltage of 3 V and a temperature of −30° C., the curve a' corresponds to a supply voltage of 2.5 V and a temperature of 120° C., the curve b' corresponds to a supply voltage of 2.5 V and a temperature of −30° C.

A single stable point is present, it corresponds to the point of intersection of all the curves for Vref=Vrefin≈1.2 V.

It is to be preferred to provide in the operational amplifier 2 (FIG. 2) a stabilizer circuit 19 of the differential amplifier 13. It may be constituted by a capacitor C1 connected between the base of the transistor Q5 of the follower circuit 22 and one of the supply terminals 21.

It may be necessary to refine the value of the temperature gradient of the charging circuit 18 if the compensation circuit 16 does not permit the voltage generated by the generator to be sufficiently stable. There are substantially unavoidably second-order parasites which obstruct that the desired value is obtained with very great precision.

In the output stage 14 of the operational amplifier 1 a regulation circuit 24 may be provided for regulating said temperature gradient on the first node A. It is represented in FIG. 3. This regulation circuit 24 may comprise a transistor Q12 whose emitter is connected to the supply terminal 21 through a resistor R12; whose collector is connected to the first node A and whose base is connected to the follower circuit 22 which now comprises a voltage divider bridge R110, R111 arranged between the supply terminal 21 and the second node B, that is to say, the emitter of the transistor Q5. The resistor R110 is connected to the emitter of the transistor Q5, the resistor R111 is connected to the supply terminal 21. The two resistors R110 and R111 have a common point C. The base of the transistor Q12 is connected to the common point C.

The regulation circuit 24 permits to generate at the charging circuit 18 a current whose temperature gradient is greater than or equal to one and this gradient is adjusted by the values of the resistances R110, R111 of the divider bridge and more particularly by the ratio (R110+R111)/R111. In the example described this ratio is 8/9 which permits the regulation circuit 24 to generate a current whose gradient is substantially equal to 1.5. As the compensation circuit 16 generates a current at the charging circuit 18 of which the gradient is substantially equal to one, these two currents are added together at the charging circuit and the resulting current in the charging circuit has a temperature gradient that depends on relative weights of the currents of the two circuits, that is to say, on the values of the resistances R10, R12. In the example described it is slightly higher than one.

A reference voltage could be tapped from another point than node B of the output stage 14. It could be tapped from the common point C between the two resistors R110, R111 of the voltage divider bridge and its value be imposed by the resistance values of the divider bridge. In the example the value could be substantially 8/9 of the voltage on the second node B and its temperature gradient would be substantially zero.

A reference voltage with a known gradient which is higher than one could be tapped from the terminals of the resistor R12 of the regulation circuit 24, but, preferably, the regulation circuit 24 is associated with an additional circuit 23 for transforming the regulation circuit into a current mirror. The same current will flow in the regulation circuit 24 as in the additional circuit 23.

The additional circuit 23 comprises a transistor Q13 whose collector is connected to the supply terminal 20, an emitter is connected to the supply terminal 21 through a resistor R13 and a base is connected to the base of the transistor Q12 of the regulation circuit 24. A reference voltage Vref1 is tapped from the emitter of the transistor Q13. In this example it has the same gradient as that shown at the emitter of the transistor Q12. By adjusting the values of the resistances of the divider bridge R110, R111, a voltage Vref1 whose temperature gradient is substantially +1.5 may be obtained at the emitter of the transistor Q13. The values of the resistances of the current mirror and of the divider bridge are indicated in the Table at the end of the description.

This gradient of +1.5 may, for example, be used for compensating for the mobility $\mu$ of the electrons whose temperature gradient is −1.5 with the preceding notation in a user circuit with MOS transistors. It is observed that this value of the temperature gradient is higher than that of a voltage proportional to the absolute temperature which is 1.

Figure 4:
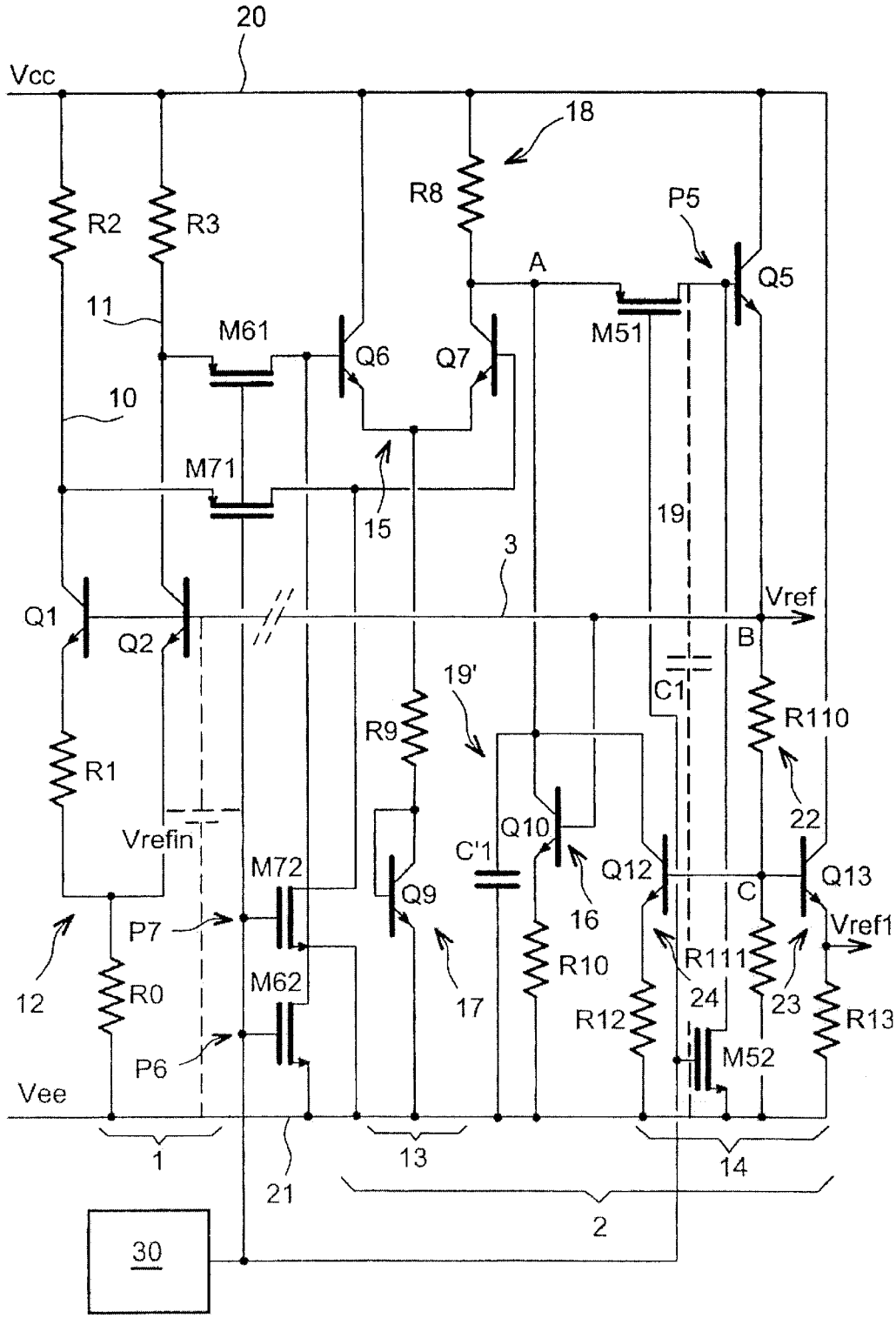
FIG. 4 is an electrical diagram of an example of a reference voltage generator according to the invention equipped with a standby mode.

Such a reference voltage generator may be equipped for operation in a standby mode. The standby mode is useful, for example, in an application as mobile telephony. FIG. 4 illustrates a similar reference voltage generator to that of FIG. 3 but equipped with a standby circuit (30, P6, P7, P5). The standby circuit is formed by various pairs P6, P7, P5 of complementary MOS transistors. Each of the transistors Q6, Q7 of the differential pair 15 and the transistor Q5 of the output circuit 22 is associated to such a pair of complementary MOS transistors P6, P7, P5, respectively.

The MOS transistors of the pair P6 associated with the bipolar transistor Q6 are referred to as M61, M62, the transistor M61 being the N-channel MOS transistor and the transistor M62 being the P-channel MOS transistor. More precisely, the transistor M61 has its drain connected to the base of the transistor Q6, its source connected to the emitter on the transistor Q2 and its gate connected to a standby control device 30. The transistor M62 has its drain connected to the base of the transistor Q6, its source connected to the supply terminal 21 connected to the potential Vee and its gate connected to the standby control device 30. The base of the transistor Q6 is thus connected to the emitter of the transistor Q2 through the MOS transistor M61.

The MOS transistors of the pair P7 associated with the bipolar transistor Q7 are referred to as M71, M72, the transistor M71 being the N-channel MOS transistor and the transistor M72 being the P-channel MOS transistor. More precisely, the transistor M71 has its drain connected to the base of the transistor Q7, its source connected to the emitter of the transistor Q1 and its gate connected to the standby control device 30. The transistor M72 has its drain connected to the base of the transistor Q7, its source connected to the supply terminal 21 connected to the potential Vee and its gate connected to the standby control device 30. The base of the transistor Q7 is thus connected to the collector of the transistor Q1 through the MOS transistor M71.

The MOS transistors of the pair P5 associated with the bipolar transistor Q5 are referred to as M51, M52, the transistor M51 being the N-channel MOS transistor and the transistor M52 being the P-channel MOS transistor. More precisely, the transistor M51 is inserted between the first node A and the base of the transistor Q5, it has its drain connected to the base of the transistor Q5, its source connected to the first node A and its gate connected to the standby control device 30. The transistor M52 has its drain connected to the base of the transistor Q5, its source connected to the supply terminal 21 connected to the potential Vee and its gate connected to the standby control device 30. The base of the transistor Q5 is then connected to the node A through the MOS transistor M51.

The standby control device 30 generates a high voltage to activate the standby mode and a low voltage, generally ground, to deactivate the standby mode.

When the standby mode is activated, the P-channel MOS transistors are equivalent to open circuits and the N-channel MOS transistors to short-circuits. When the standby mode is deactivated, the reverse is true.

To give a short alarm time to the reference voltage generator when the standby mode changes from the deactivated mode to the activated mode, it is possible for the stabilization circuit 19, instead of being directly connected to the base of the transistor Q5, to be connected to the source of the MOS transistor M51. In effect, when the capacitor C1 is connected directly to the base of the transistor Q5, in the standby mode, it is discharged because its two terminals are substantially at the potential of the supply terminal 21 connected to the potential Vee. At the wake it is charged thanks to the current that passes through the charging circuit 18 and the charging time is equal to the product of R8.C1.

By placing the stabilization circuit 19' between the node A and the supply terminal 21 connected to the potential Vee in the standby mode, the voltage on node A is substantially equal to Vcc and at the wake the capacitor C'1 is discharged through the transistor Q7 and the resistor R9, which is much faster than a charging operation.

Figure 8:
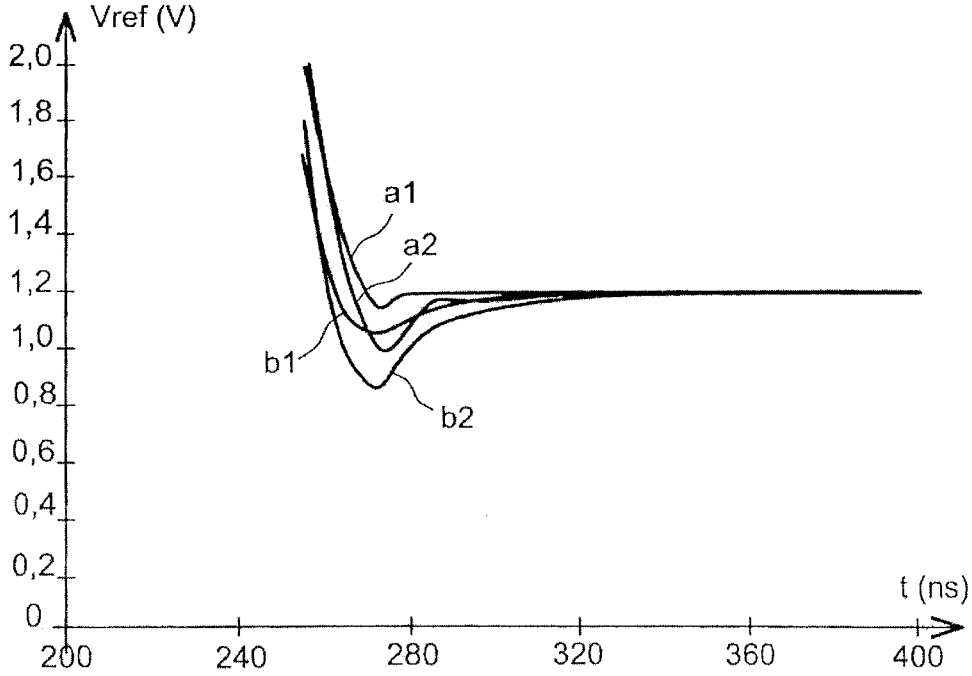
FIG. 8 shows the variations of the reference voltage when the active standby mode changes to the inactive standby mode for various supply voltages and various temperatures.

FIG. 8 shows the variations of the reference voltage Vref as a function of time for various supply voltages and various temperatures, during the change from the activated standby mode to the deactivated standby mode. The curve a1 corresponds to a supply voltage of 3 V and a temperature of −30° C., the curve a2 corresponds to a supply voltage of 3 V and a temperature of 120° C., the curve b1 corresponds to a supply voltage of 2.5 V and a temperature of −30° C., the curve b2 corresponds to a supply voltage of 2.5 V and a temperature of 120° C. The wakening time is very brief, of the order of about thirty nanoseconds.

Figure 9:
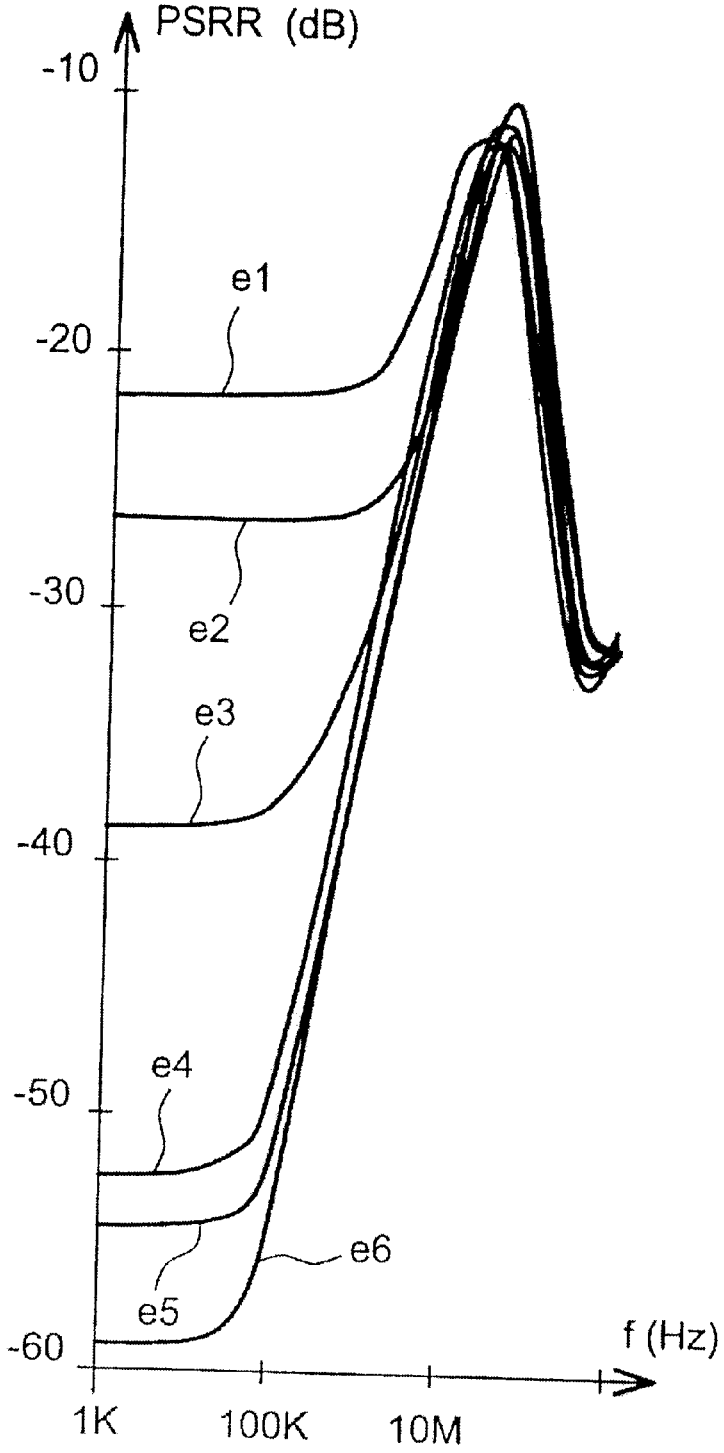
FIG. 9 shows the variations of the power supply rejection ratio as a function of the frequency for various supply voltages and various temperatures.

The operational amplifier 2 no longer having much gain is easy to stabilize and has a large passband, which permits its power supply rejection ratio to be much better than the prior art and this over a wide frequency band. FIG. 9 shows pairs of curves illustrating this supply rejection ratio as a function of the frequency for various supply voltages and two extreme temperatures. The curves e1, e2 correspond to a supply voltage of 2.5 V, the curves e3, e4 correspond to a supply voltage of 2.7 V, the curves e5, e6 correspond to a supply voltage of 3 V. The supply rejection ratio is all the better as the supply voltage is high, the circuit having thus been optimized. In effect, the specificness of the circuit is that it has optimal operation between about 2.7 V and 3 V and that it is functional between about 2.5 V and 2.7 V. The circuit could have been optimized differently.

VALUE TABLE

| NAME | VALUE | GRADIENT | VOLTAGE DROP |
|---|---|---|---|
| Vcc-Vee | 2.8 | 0 | — |
| R2, R3 | 16.8 kΩ | 1 | 0.8 V |
| Vbe(Q1, Q2, Q6, Q7, Q5, Q9, Q10, Q12, Q13) | | −0.5 | 0.8 V |
| R1 | 1 kΩ | 1 | 0.05 V |
| R0 | 4.2 kΩ | 1 | 0.4 V |
| R8 | 10 kΩ | 0.5 | 0.8 V |
| R9 | 4.1 kΩ | 0 | 0.4 V |
| R10 | 40 kΩ | 1 | 0.4 V |
| R12, R13 | 15 kΩ | 1.5 | 0.27 V |
| R110 | 1 kΩ | — | — |
| R111 | 8 kΩ | — | — |

All the bipolar transistors have been represented by NPN transistors but it is possible to replace them with PNP bipolar transistors by effecting all the inversions notably suitable for the charging and source circuits.

Although various embodiments of the present invention have been represented and described in a detailed way, it will be understood that various changes and modifications may be applied without leaving the scope of the invention.

What is claimed is:

1. A generator of at least one reference voltage (Vref, Vref1) comprising, connected between two power supply terminals (20, 21), an input stage (1) having a portion (R0) that is proportional to the absolute temperature and delivering a potential that is substantially independent of temperature, an operational amplifier (2) comprising:

a differential amplifier stage (13) connected to the input stage including a charging circuit (18) and a source circuit (17) and an output stage (14) connected at a first node to the charging circuit, intended to be connected to the input stage by a loop which is closed and delivering the reference voltage, characterized in that the source circuit (17) and charging circuit (18) comprise regulation means (R8, R9) for regulating the reference voltage (Vref, Vref1) even when the loop (3) connecting the input stage (1) to the output stage (14) is open, which reference voltage is then delivered in a manner which is substantially independent of the manufacturing process of the generator, variations of the supply voltage and has a given dependence on temperature.

2. A generator as claimed in claim 1, characterized in that the regulation means (R8, R9) impose that with an open loop (3), during a variation of the supply voltage, substantially the same variation is reflected in the source circuit (17) as the charging circuit (18) in a way that the voltage appearing on the first node (A) is practically independent of the variations of the supply voltage, the current in the source circuit (17) being substantially independent of temperature.

3. A generator as claimed in claim 1, in which the differential amplifier stage (2) comprises a differential pair of transistors (Q6, Q7), characterized in that the source circuit (17) comprises a resistor (R9) and a diode (Q9) connected in series, the resistor (R9) being connected to the differential transistor pair (Q6, Q7) and the diode (Q9) to one of the supply terminals (21), the diode having a temperature gradient so that even when the loop (3) is open, said gradient compensates for the temperature gradients of the input stage (1) and of the differential amplifier stage (13) in such a way that the voltage on the terminals of the resistor (R9) is substantially independent of temperature and manufacturing process.

4. A generator as claimed in claim 1, characterized in that the charging circuit (18) comprises a resistor (R8) connected between the first node (A) and one of the supply terminals (20), the ratio between the value of the resistance (R8) of the charging circuit (18) and the value of the resistance (R9) of the source circuit (19) being adjusted in such a way that, even with an open loop (3), during a variation of the supply voltage, substantially the same variation is reflected on the source circuit (17) and on the charging circuit (18), so that the voltage appearing on the first node (A) is practically independent of variations of the supply voltage.

5. A generator as claimed in claim 1, characterized in that the operational amplifier (1) comprises a compensation circuit (16) connected to the first node (A) and to the output stage (14) at a second node (B) with the closed loop (3), the compensation circuit (16) and the source circuit (17) maintaining on the first node (A) a voltage that substantially compensates for the voltage produced by the output stage (14), rendering the voltage on the second node (B) substantially independent of temperature and variations of the supply voltage even when the loop (3) is open.

6. A generator as claimed in claim 5, characterized in that the compensation circuit (16) comprises a bipolar transistor (Q10) whose emitter is connected to one (21) of the supply terminals through a resistor (R10), whose collector is connected to the first node (A) and whose base is connected to the output stage (14) at the second node (B).

7. A generator as claimed in claim 1, characterized in that the output stage (14) comprises a follower circuit (22) including a bipolar transistor (Q5) whose emitter is connected to one of the supply terminals (21) through at least one resistor (R7) and to the loop (3) when it is closed, whose collector is connected to the other supply terminal (20) and whose base is connected to the first node (A), one output of the generator being found at the emitter of the bipolar transistor (Q5).

8. A generator as claimed in claim 1, characterized in that the output stage (14) comprises a follower circuit (22) including a bipolar transistor (Q5) whose emitter is connected to one of the supply terminals (21) through a voltage divider bridge (R110, R111) and to the loop (3) when it is closed, whose collector is connected to the other supply terminal (20) and whose base is connected to the first node (A), one output of the generator being found at a common point (C) between two resistors (R110, R111) of the voltage divider bridge.

9. A generator as claimed in claim 7, characterized in that the output stage (14) comprises, in association with the follower circuit (22), a regulation circuit (24) for regulating the temperature gradient of the voltage on the first node (A), this regulation circuit (24) being connected between the first node (A) and one of the supply terminals (21) and being connected to a common point (C) between two resistors (R110, R111) of the voltage divider bridge, this regulation circuit (24) generating a current whose temperature gradient is adjustable by the choice of the resistors (R110, R111) of the bridge.

10. A generator as claimed in claim 9, characterized in that this regulation circuit (24) comprises a bipolar transistor (Q12) whose emitter is connected to one of the supply terminals (21) through a resistor (R12), whose collector is connected to the first node (A) and whose base is connected to the common point (C) between two resistors (R110, R111) of the voltage divider bridge, one output of the generator being found at the emitter of the transistor (Q12) of the regulation circuit (24).

11. A generator as claimed in claim 9, characterized in that the regulation circuit (24) co-operates with an additional circuit (23) that has a transistor (Q13) for forming a current mirror, the output being found at the emitter of the transistor (Q13) of the additional circuit (23).

12. A generator as claimed in claim 1, characterized in that it comprises a standby circuit (30, P5, P6, P7) for putting the generator in the standby mode, the standby circuit (30, P5, P6, P7) including various pairs (P6, P7) of complementary MOS transistors located in the differential amplifier stage (13) and a pair (P5) of complementary MOS transistors located in the output stage (14), these MOS transistors being controlled by a standby mode control device (30).

13. A generator as claimed in claim 1, characterized in that it delivers a reference voltage based on the forbidden energy band of a semiconductor material.

14. A converter including a generator as claimed in claim 1.

15. An apparatus intended for the reception and/or transmission of radio telecommunication signals, including a generator as claimed in claim 1.

* * * * *